US005250920A

United States Patent [19]

Fujihisa et al.

[11] Patent Number: 5,250,920

[45] Date of Patent: Oct. 5, 1993

[54] REMOTE CONTROLLED RELAY

[75] Inventors: Hiroaki Fujihisa; Manabu Sogabe, both of Fukuyama, Japan

[73] Assignee: Mitsubishi Denki Kabushiki Kaisha, Tokyo, Japan

[21] Appl. No.: 799,124

[22] Filed: Nov. 27, 1991

[51] Int. Cl.[5] ..... H01H 9/02

[52] U.S. Cl. ..... 335/202; 335/14; 335/20

[58] Field of Search ..... 335/6, 14, 20, 202

[56] References Cited

U.S. PATENT DOCUMENTS 4,816,792 3/1989 Belbel et al. ..... 335/14
5,003,139 3/1991 Edds et al. ..... 335/35

FOREIGN PATENT DOCUMENTS 0186393 7/1986 European Pat. Off. .
0458294 11/1991 European Pat. Off. .
0458301 11/1991 European Pat. Off. .
0458302 11/1991 European Pat. Off. .
1957482 10/1970 Fed. Rep. of Germany .
7235698 3/1973 Fed. Rep. of Germany .
64-43806 2/1989 Japan .

*Primary Examiner*—Lincoln Donovan
*Attorney, Agent, or Firm*—Burns, Doane, Swecker & Mathis

[57] ABSTRACT

Assembly of a remote controlled relay has steps of: previous assembling of units which are constituted by components having a concern with each other; positioning of the units on a base member; soldering of wires of electric components; coupling on the units which have mechanical concern; and covering of the units by a cover member which is fit and fixed to the base member.

6 Claims, 9 Drawing Sheets

REMOTE CONTROLLED RELAY

BACKGROUND OF THE INVENTION

1. Field of the Invention

The present invention relates to an improvement in a remote controlled relay.

2. Description of the Prior Art

A conventional remote controlled relay shown in, for example, Gazette of Published Examined Japanese Utility Model Application Hei 1-43806 is shown in FIG. 9, which is a cross-sectional side view showing the constitution of the conventional remote controlled relay. In FIG. 9, an electromagnetic apparatus 102 is contained in a housing 101. The electromagnetic apparatus 102 comprises a bobbin 104, whereon an electromagnetic coil 103 is wound, and a pair of yokes 105 and 106, which contact outer face of the bobbin 104. The yokes 105 and 106 are respectively put in contact with both poles of a permanent magnet 107. A plunger 108 is slidably provided in a center hole part 104*a* of the bobbin 104. An end part 108*a* of the plunger 108 extends beyond the yoke 105 through an opening 105*a* of the yoke 105. A compression spring 109 is provided for engaging the end part 108*a*. A fixed iron core 122 is provided in the center hole part 104*a* of the bobbin 104 and an end thereof is fixed on the yoke 106. An insulative member 110 is fixed on the end part 108*a* of the plunger 108 and a moving member 112 having a moving contact 111 is fixed on the insulative member 110. The moving contact 111 is positioned for facing to a fixed contact 114 which is fixed to a terminal 113 whereto a main circuit is to be connected. By the movement of the plunger 108, the moving contact 111 is driven to move toward and away from from the fixed contact 114. The moving member 112 is electrically connected to another terminal 116 whereto the main circuit is to be connected by a shunt 115. A pair of control terminals 117*a* and 117*b* are provided in parallel and one control terminal 117*a* is connected to the electromagnetic coil 103 and the other control terminal 117*b* is connected to a common terminal (COM) of a switch 118. Other normally opened and closed terminals (NO, NC) of the switch 118 are connected to the electromagnetic coil 103 via a diode unit 119. A leaf spring 120 is provided in a manner to interlock the plunger 108 for switching the switch 118.

In the above-mentioned conventional remote controlled relay, components having a mutual relation to each other are designed not to constitute a unit and the electric components must be wired in the housing 101 after assembling the components on the housing 101. As a result, productivity in manufacturing the relay is not very good owing to necessity of a great deal of assembling of components and wiring.

SUMMARY OF THE INVENTION

One purpose of the present invention is to solve the above-mentioned problems and to provide an improved remote controlled relay wherein elements having a mutual relation to each other are constituted as a unit for improving manufacturing efficiency and facilitating assembly.

A remote controlled relay in accordance with the present invention comprises:

a housing which consists of a base member and a cover member and has a center large space which is defined by partition walls, a center small space which is positioned on and communicated to the front portion of the center large space and a right space and a left space which are positioned symmetrical to the center large space and communicated to the center small space;

a main driving unit having an electromagnetic device and a driving mechanism driven by an electromagnetic device, which is straddled in the center large space and the center small space;

a circuit unit provided in the right space and having a switch for changing the current direction to be supplied to the electromagnetic device and a pair of remote control terminals which are to be connected to a remote control circuit, whereto lead wires of the electromagnetic device are electrically connected;

a fixed contact unit having a fixed contact, provided on the bottom of the left space;

a moving contact unit having a moving contact, coupled to the driving mechanism by a pin-joint for being driven in a manner to contact to and depart from the fixed contact and provided in the left space; and fixing means for fixing the cover member to the base member after containing the main driving unit, the circuit unit, the moving contact unit and the fixed contact unit on the base member.

In the remote controlled relay in accordance with the present invention as configured above, most of the main components of the relay are grouped into several units; the main driving unit, the circuit unit, the fixed contact unit and the moving contact unit. Respective units are previously assembled and mounted on the base member of the housing. Thereafter, the lead wires of the main driving unit are electrically connected to the circuit unit and the moving contact unit is coupled to the main driving unit by insertion of a pin, so that assembly of the remote controlled relay in accordance with the present invention is easily completed.

While the novel features of the invention are set forth particularly in the appended claims, the invention, both as to organization and content, will be better understood and appreciated, along with other objects and features thereof, from the following detailed description taken in conjunction with the drawings.

BRIEF DESCRIPTION OF THE DRAWINGS

FIG. 3 is a cross-sectional side view of the remote controlled relay shown in FIG. 1 when the relay is switched on.

It will be recognized that some or all of the Figures are schematic representations for purposes of illustration and do not necessarily depict the actual relative sizes or locations of the elements shown.

DETAIL DESCRIPTION OF PREFERRED EMBODIMENT

Figure 1:
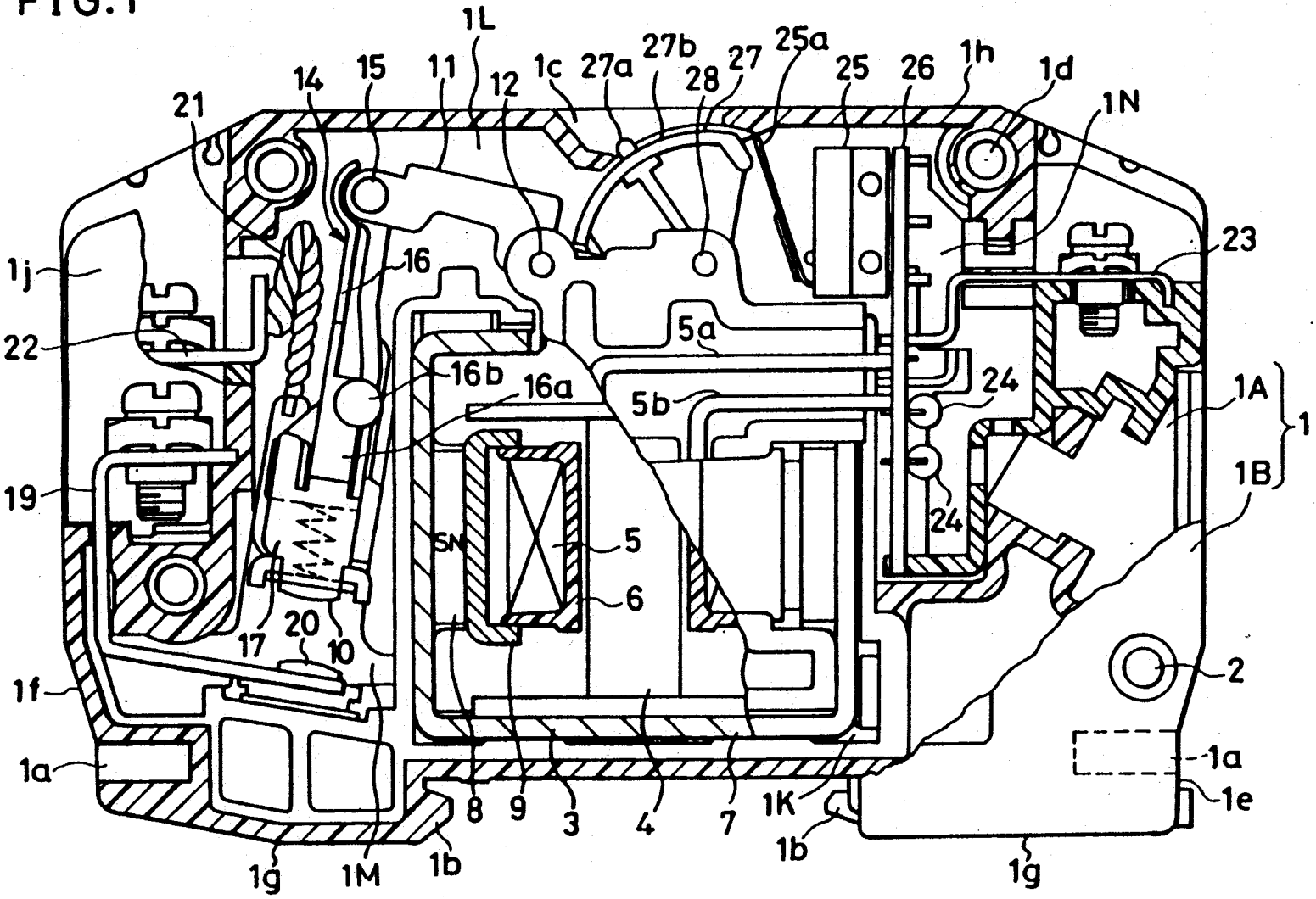
FIG. 1 is a cross-sectional side view showing an arrangement of a remote controlled relay in accordance with the present invention when the relay is switched off.
Figure 2:
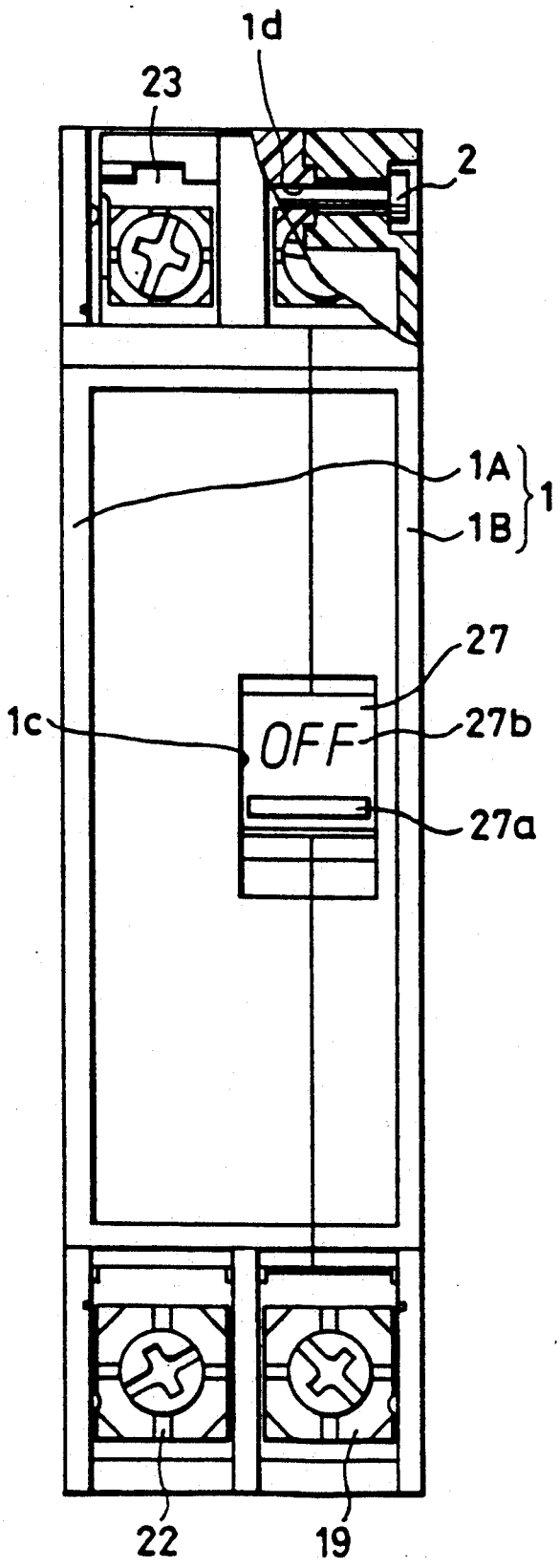
FIG. 2 is a plan view of the remote controlled relay shown in FIG. 1.
Figure 3:
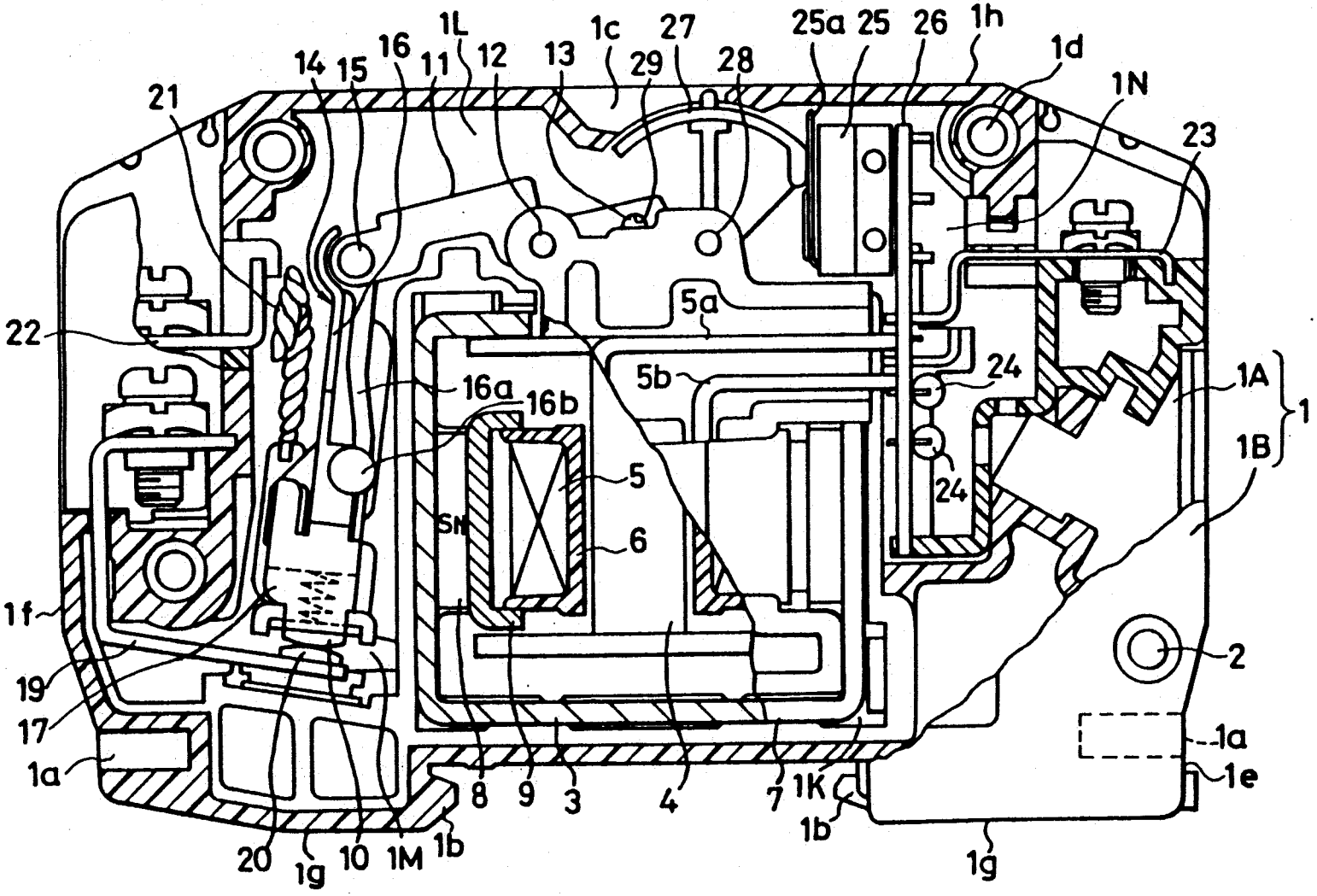
Figure 4:
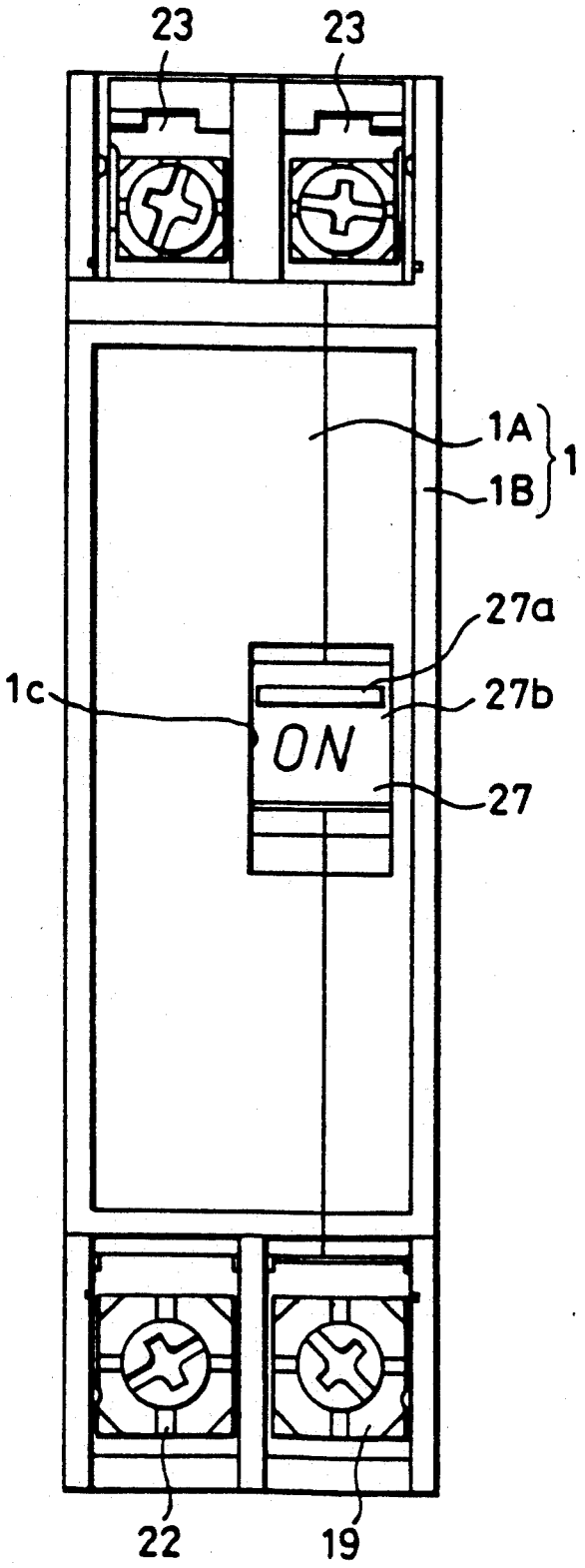
FIG. 4 is a plan view of the remote controlled relay shown in FIG. 3.
Figure 5:
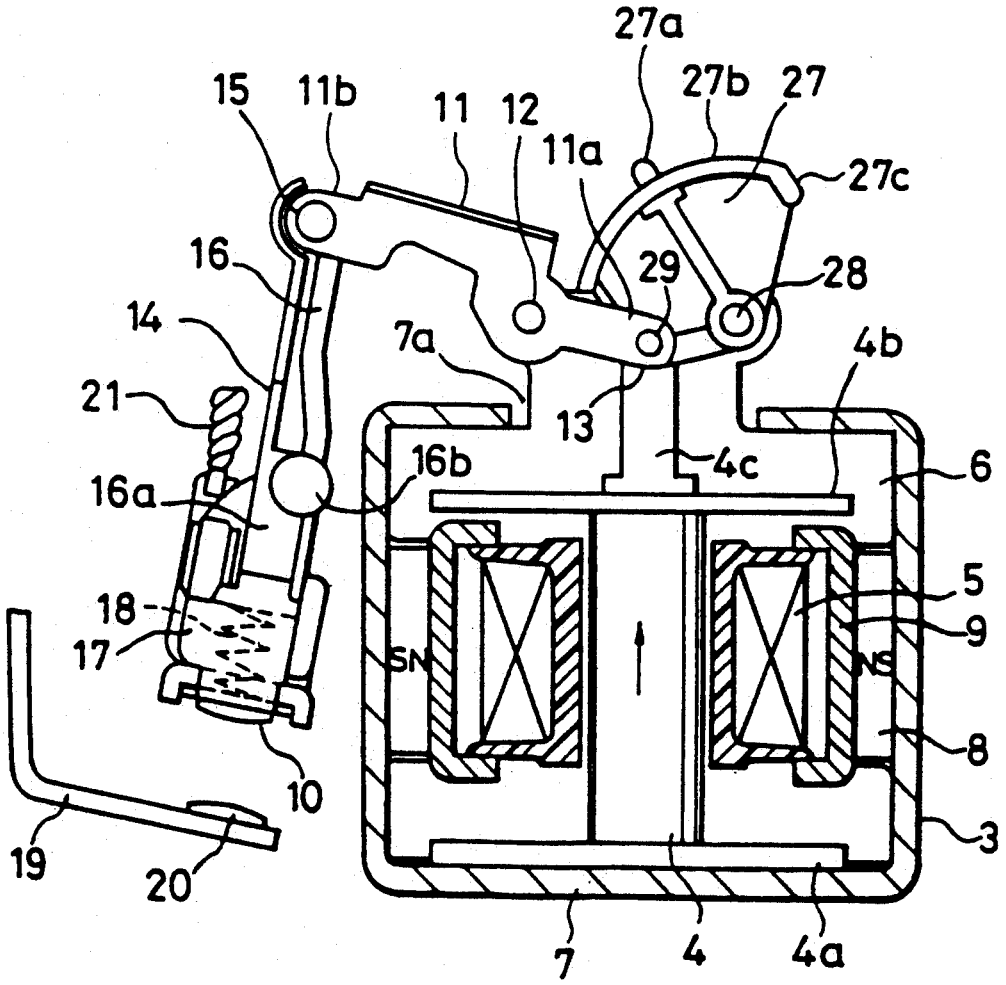
FIG. 5 is a cross-sectional side view showing primary components of the remote controlled relay shown in FIG. 1.
Figure 6:
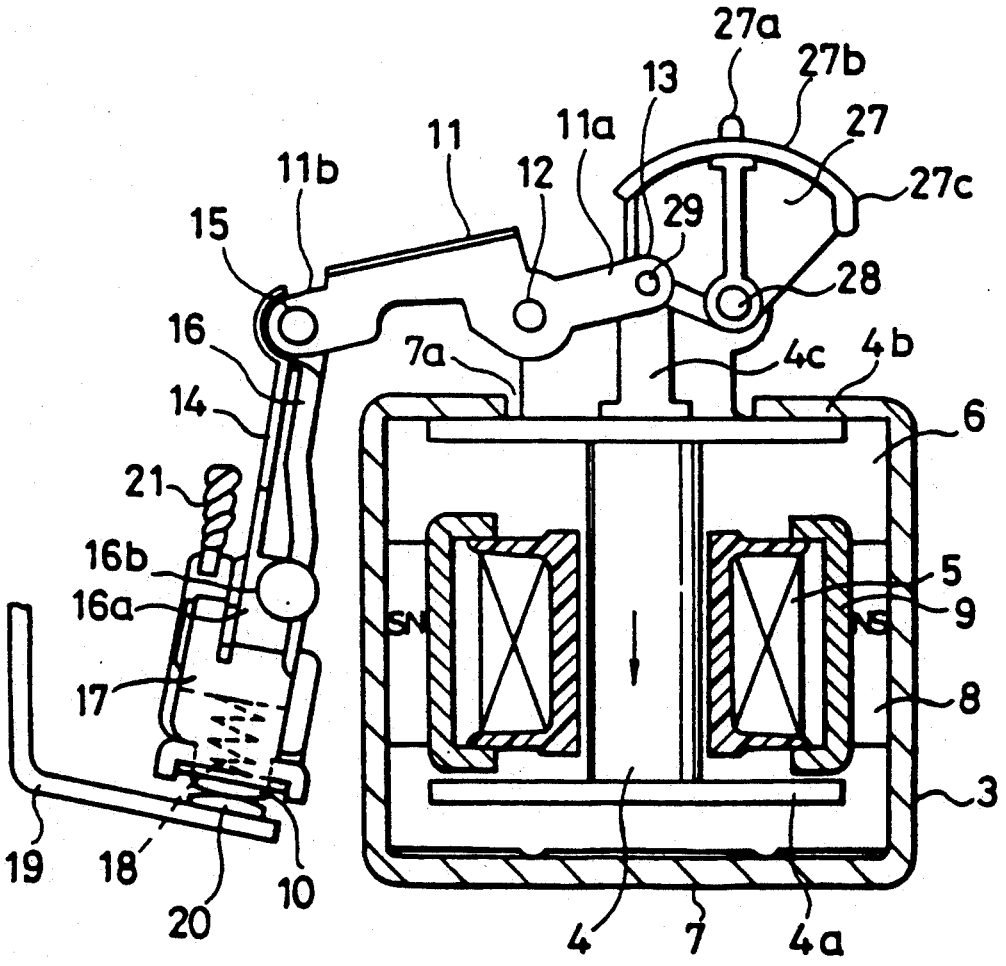
FIG. 6 is a cross-sectional side view showing the primary components of the remote controlled relay shown in FIG. 3.
Figure 7:
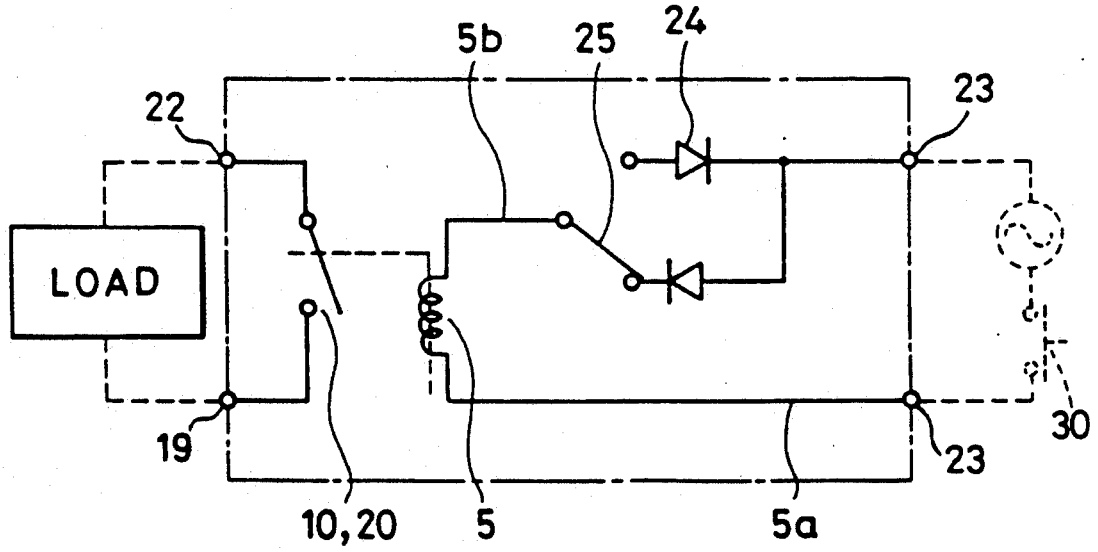
FIG. 7 (Prior Art)
FIG. 7 is a circuit diagram showing a circuit of the typical remote controlled relay.
Figure 8:
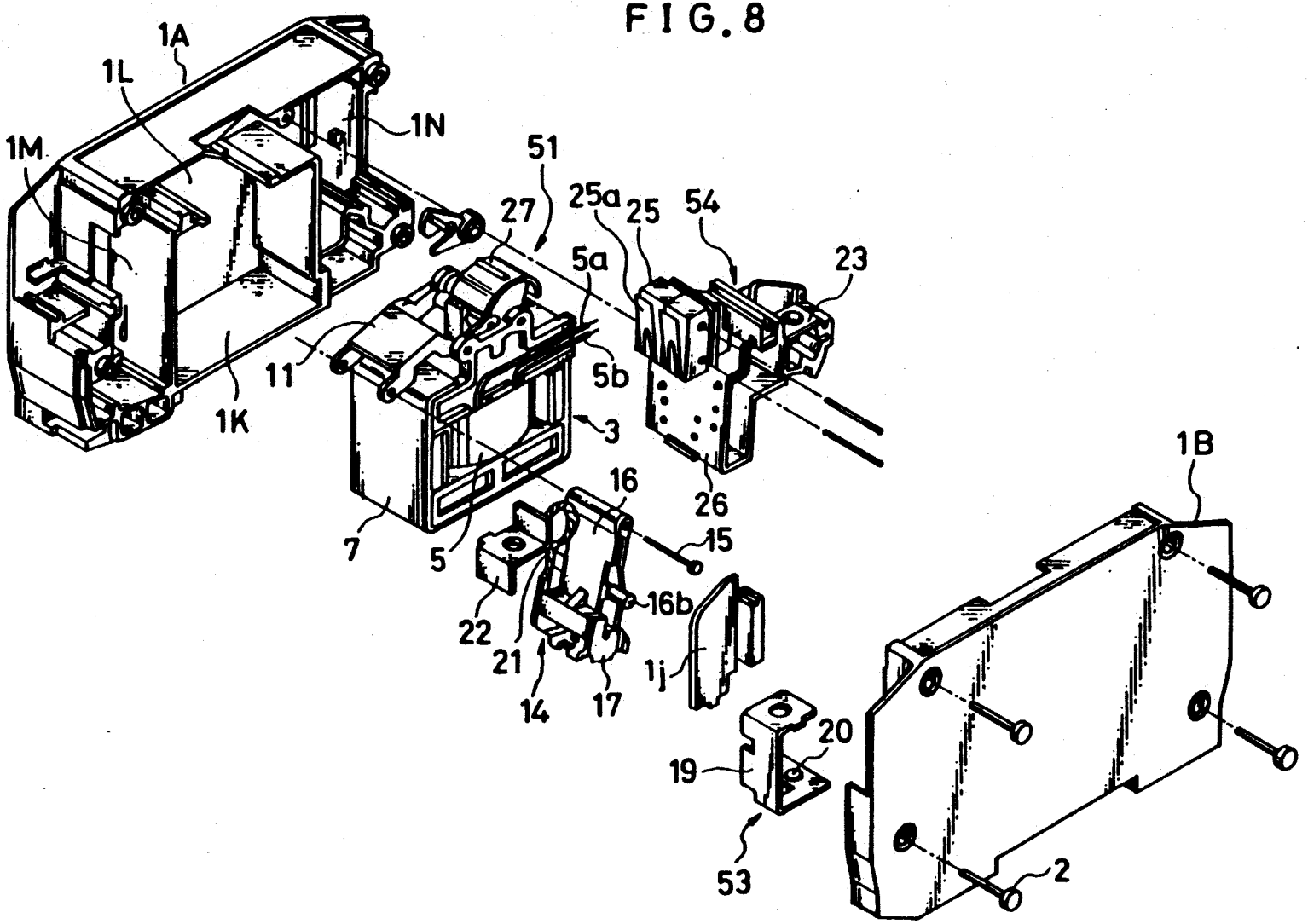
FIG. 8 is an exploded perspective view showing constitution of the remote controlled relay in accordance with the present invention.
Figure 9:
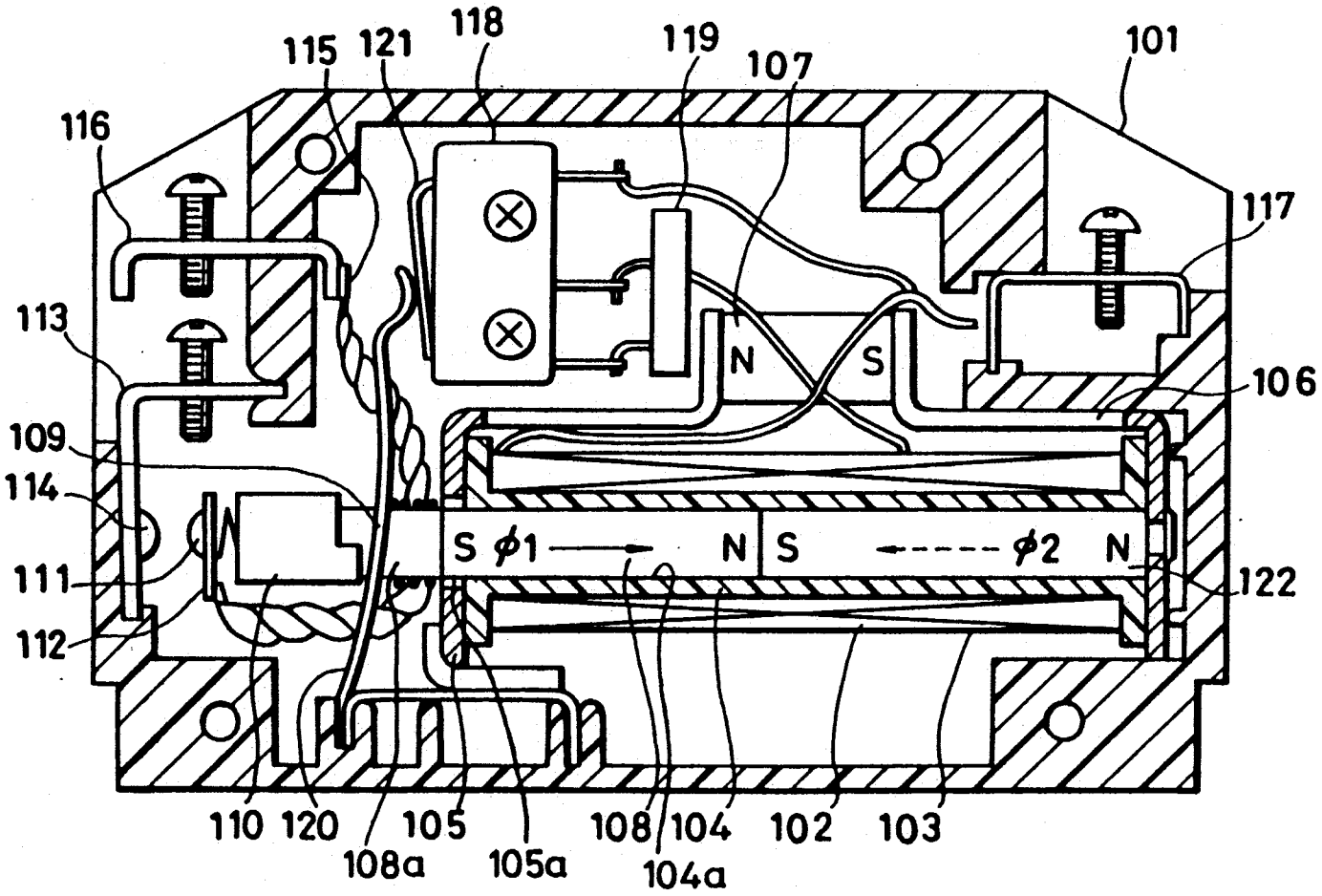
FIG. 9 (Prior Art)
FIG. 9 is the cross-sectional side view showing a constitution of the conventional remote controlled relay.

A preferred embodiment of a remote controlled relay in accordance with the present invention is described referring to FIGS. 1–6 and 8. FIG. 1 is a cross-sectional side view showing a constitution of a remote controlled relay in accordance with the present invention when the relay is switched off (hereinafter abbreviated as OFF). FIG. 2 is a plan view of the remote controlled relay shown in FIG. 1. FIG. 3 is a cross-sectional side view of the remote controlled relay shown in FIG. 1 when the relay is switched on (hereinafter abbreviated as ON). FIG. 4 is a plan view of the remote controlled relay shown in FIG. 3. FIG. 5 is a cross-sectional side view showing main parts of the remote controlled relay shown in FIG. 1. FIG. 6 is a cross-sectional side view showing the main parts of the remote controlled relay in a condition shown in FIG. 3. FIG. 7 is a circuit diagram showing a circuit of the typical remote controlled relay. FIG. 8 is an exploded perspective view showing constitution of the remote controlled relay in accordance with the present invention.

In the figures, a housing 1 consists of a base member 1A and a cover member 1B. The housing 1 has: a pair of grooves **1*a* on its both side walls 1*e* and 1*f* in the vicinity of a bottom face 1*g*, whereto fixing bands (not shown in the figure) are to be coupled; a pair of protrusions 1*b* in the vicinity of the center part of the bottom face 1*g*, whereby the housing 1 is to be fixed on a DIN standard rails (not shown in the figure); and an opening 1*c* on its top face 1*h*. The base member 1A and the cover member 1B respectively have four holes 1*d*, and each hole 1*d* on the base member 1A faces to the other hole on the cover member 1B. The base member 1A and the cover member 1B are connected and fixed with each other by rivets 2 which are fit in the holes 1*d***.

Do shown in FIG. 8 most of main components consisting the relay are grouped into several units of a main driving unit 51, a circuit unit 54, a fixed contact unit 53 and a moving contact unit 14. Respective units 51, 53, 54 and 14 are previously assembled and mounted on the base member 1A of the housing 1.

As shown in FIG. 8, the housing 1 consisting of the base member 1A and the cover member **1*b* has a center large space 1K which is encircled by partition walls 1*h*, and a center small space 1L which is positioned above and in communication with the front portion of the center large space 1K. The right and left spaces 1M and 1N are positioned symmetrically with respect to the communicating portion of the center large space 1K and the center small space 1L and in communication with center small space 1L**.

Further shown in FIG. 8, the main driving unit 51 comprises a driving magnet 3 and a driving mechanism 51. The driving magnet 3 is, for example as shown in FIG. 1 or 3, positioned on substantially the center of the housing 1, wherein the driving magnet 3 provided in a manner that the moving direction of its plunger 4 is perpendicular to the bottom face **1*g* of the housing 1. The driving magnet 3 is a polarized-type one, and as shown in FIGS. 5 and 6, the plunger 4 is slidably provided in a center hole of a bobbin 6 whereon an electromagnetic coil 5 is wound, and has armatures 4*a*, 4*b* on both ends. A first yoke 7 encloses the bobbin 6 and has an opening wherefrom a rod part 4*c* (FIGS. 5 and 6) of the plunger 4** projects upward.

Permanent magnets 8 are provided on inner walls of the first yoke 7, for example, at right and left hands in the figures, and respective permanent magnets 8 are fixed on the first yoke 7 in a manner that one of faces of poles of the magnets 8 contact to the inner face of the first yoke 7. The other faces of the magnets 8 having the other polarity are fixed to a second yoke 9 having channel-section. The second yokes 9 are respectively provided in a manner that brim parts of the bobbin 6 of the driving coil 5 are fit in the channel-section part of the second yokes 9.

A link 11 for transmitting the movement of the plunger 4 to a moving contact 10 is provided above the driving magnet 3. The link 11 is rotatively pivoted by a pin 12, an end **11*a* whereof is pin-jointed to an end of the rod part 4*c* of the plunger 4 by a connecting pin 13**.

An operation handle 27 is rotatively pivoted by a pin 28 on a point opposite to the link 11 against the plunger 4. The operation handle 27 is coupled to the rod part **4*c* of the plunger 4 by a coupling pin 13, wherein an end of the coupling pin 13 is press-fit in a coupling hole 29 (shown in FIG. 3) Thereby, the operation handle 27 is rotated in a direction opposite to the rotation direction of the link 11. The operation handle 27 has a knob 27*a* which to be is operated from the outside of the housing 1 by hand, and the knob 27*a* is positioned in the opening 1*c* of the housing 1 (the base member 1A and the cover member 1B). On parts of the surface of the operation handle 27 which are positioned symmetrical to the knob 27*a*, indications 27*b* for indicating ON state and OFF state of the relay are provided and the indications 27*b* are shown through the opening 1*c***.

As shown in FIG. 1, 3, 5, 6 or 8, to moving contact unit 14 comprises: an insulative member 16 which is pin-jointed on an end thereof to the other end **11*b* of the link 11 by a pin 15; a moving base member 17 which is slidably fit in a guide groove 16*a* formed on the other end of the insulative member 16 and whereto the moving contact 10 is fixed; and a compression spring 18 provided in a manner to supply a pressure to the moving contact 10**.

The fixed contact unit 53 comprises a main terminal 19 which is to be connected to a main circuit (not shown in the figure) and a fixed contact 20 provided on the main terminal 19.

In the moving contact unit 14, protrusion(s) **16*b* formed on the insulative member 16 is (are) slidably fit in groove(s) of the base member 1A (and the cover member 1B) which is (are) not shown in the figure, and thereby, the moving contact unit 14 is driven by the movement of the plunger 4 in a manner that the moving contact 10 contacts to and departs from the fixed contact 20. The moving base member 17 is electrically connected to another terminal 22 of another main circuit. The terminals 19 and 22 are insulatedly separated by a separation wall 1*j***.

A circuit unit 54 comprises a switch 25, a printed circuit substrate 26, diodes 24 and a pair of remote control terminals 23 whereto wires for remote control are to be connected. One of the remote control terminals 23 is connected to a lead wire **5*a* of the driving coil 5 and the other remote control terminal 23** is connected to the other lead wire 5*b* of the coil 5 via a diode 24 and a switch 25 on a printed circuit substrate 26. The circuit diagram of the remote controlled relay is shown in FIG. 7.

Afore-mentioned operation handle 27 has an operation part 27*c* and an actuator 25*a* of the switch 25 is switched on and off by the operation part 27*c*.

Assembling steps of the remote controlled relay in accordance with the present invention are described.

Previously, the main driving unit 51, the circuit unit 54 and the moving contact unit 14 are assembled as shown in FIG. 8 and the movement and/or the operation characteristics of respective units are checked individually.

First, the main driving unit 51 is contained in and mounted on the center large space 1K of the housing 1 (base member 1A), and the circuit unit 54 is contained in and mounted on the right space 1N. After that, the lead wires 5*a* and 5*b* of the electromagnetic coil 5 of the main driving unit 51 are soldered on the printed circuit substrate 26 of the circuit unit 54.

Second, the moving contact unit 14 is contained in the left space 1M of the base member 1A and the moving contact unit 14 is coupled to the link 11 of the main driving unit 51 by insertion of the pin 15. After that, the fixed contact unit 53 is contained in and fixed on the bottom part of the left space 1M.

Finally, the cover member 1B is fit to the base member 1A. The cover member 1B and the base member 1A are fixed by rivets 2. As a result, respective units 14, 51, 53, 54 and so on are fixed on the housing 1.

As mentioned above, most of main components consisting the relay are grouped into several units of the main driving unit 51, the circuit unit 54, the fixed contact unit 53 and the moving contact unit 14. And respective units 51, 53, 54 and 14 are previously assembled and mounted on the base member 1A of the housing 1. Thereafter, the lead wires 5*a* and 5*b* of the main driving unit 51 are electrically connected to the circuit unit 54 and the moving contact unit 14 is coupled to the main driving unit 51 by insertion of a pin 15. Therefore, the assembly of the remote controlled relay in accordance with the present invention is drastically easier and more efficient in comparison with the conventional configuration of the remote controlled relay wherein components and parts are mounted directly to the housing.

Next, operation of the above-mentioned remote controlled relay in accordance with the present invention is described.

FIGS. 1 and 5 show the state that the remote controlled relay is switched off. At this time, the plunger 4 is held in a manner that the armature 4*a* is attracted on the bottom face of the first yoke 7 by magnetic flux of the permanent magnet 8, and the moving contact 10 and the fixed contact 20 are respectively at stable positions wherein the contacts 10 and 20 are apart from each other. At this time, the operation handle 27 indicates OFF state.

In such a state that the main circuit is opened, when the driving coil 5 is excited by switching on a remote control switch 30 (shown in FIG. 7) which is connected to the terminals 23 of the control circuit, the magnetic flux is produced for reducing the magnetic attraction force by the permanent magnets 8 on the armature 4*a* of the plunger 4 and increasing the magnetic attraction force by the coil 5 on the other armature 4*b* of the plunger 4. Thereby, the plunger 4 is driven in a direction shown by arrow in FIG. 5, the link 11 is rotated in counterclockwise direction, the moving contact 10 is moved to the fixed contact 20 and finally the main circuit is closed by contacting of the moving contact 10 and the fixed contact 20. In this state, the armature 4*b* of the plunger 4 is attracted and held on an upper inner face of the first yoke 7. At this time, the operation handle 27 is rotated in clockwise direction by the movement of the plunger 4 and the indication is changed from OFF to ON. In such a sequence of the operation, the operation handle 27 drives the actuator 25*a* of the switch 25 and thereby the switch 25 is turned on or off.

Under the state that the main circuit is turned on, when the remote control switch 30 shown in FIG. 7 is switched on, the electro-magnetic coil 5 is excited to produce magnetic flux for reducing the magnetic attraction force by the permanent magnets 8 on the armature 4*b* of the plunger 4. And at the same time, increasing the magnetic attraction force by the coil 5 on the other armature 4*a* of the plunger 4. Thereby, the plunger 4 is driven in a direction shown by arrow in FIG. 6, the link 11 is rotated in clockwise direction, the moving contact 10 is moved to be departed from the fixed contact 20, and finally the main circuit is opened by departing of the moving contact 10 from the fixed contact 20. In this state, the armature 4*a* of the plunger 4 is attracted on the bottom face of the first yoke 7, that is the initial stable state. At this time, the operation handle 27 is rotated in counter-clockwise direction by the movement of the plunger 4 and the indication is changed from ON to OFF. In such a series of the operation, the operation handle 27 drives the actuator 25*a* of the switch 25, and thereby the switch 25 is turned off.

For manually switching on and off the main contacts from outside of the housing 1, when the knob 27*a* of the operation handle 27 is driven by hand, the plunger 4 is directly driven, and thereby the contacts can be switched on and off. In such a manual operation, a removing force, which is larger than the attraction force of the permanent magnet for attracting the plunger 4 on the first yoke 7, is directly applied on the plunger 4 by hand, and thereby the plunger 4 is forcibly moved and shifted to the other stable state. In this manual operation also, the movement of the moving contact unit 14 and the switching operation of the control switch 25 are the same as the aforementioned remote control.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A remote controlled relay comprising:

a housing which includes a base member and a cover member and has a center large space which is defined by partition walls, a center small space which is positioned on and in communication with the front portion of said center large space, and a first space and a second space which are positioned respectively on either side of said center large space and in communication with said center small space;

a main driving unit having an electromagnetic device and a driving mechanism driven by said electromagnetic device, said main driving unit straddling said center large space and said center small space;

a circuit unit provided in said first space and having a switch for changing the current direction to be supplied to said electromagnetic device and a pair of remote control terminals which are to be connected to a remote control circuit, whereto lead wires of said electromagnetic device are electrically connected;

a fixed contact unit having a fixed contact, provided on the bottom of said second space;

a moving contact unit having a moving contact, coupled to said driving mechanism by a pin-joint for being driven in a manner to make and break contact with said fixed contact and provided in said second space; and fixing means for fixing said cover member to said base member wherein said main driving unit, said circuit unit, said moving contact unit, and said fixed contact unit are mounted on said base member.

2. Apparatus as in claim 1 wherein the first space is located on the right side of said center large space.

3. Apparatus as in claim 1 wherein the first space is located on the left side of said center large space.

4. A method of assembling a remote control relay comprising the steps of:

preassembling a main driving unit;

preassembling a circuit unit;

preassembling a moving contact unit;

mounting said main driving unit in a large center space in a housing;

mounting said circuit unit in a first space in said housing to one side of said large center space and electrically connecting said circuit unit to said main driving unit;

mounting said moving contact unit in a second space in said housing on a second side of said large center space opposite said first space;

mechanically coupling said moving contact unit and said main driving unit;

mounting a fixed contact unit in said second space adjacent to said moving contact unit;

mounting a cover member on said housing.

5. A method as claimed in claim 4 wherein said first space is located to the left of said large center space.

6. A method as claimed in claim 4 wherein said first space is located to the right of said large center space.

* * * * *